United States Patent [19]

Takahashi et al.

[11] Patent Number: 4,947,819

[45] Date of Patent: Aug. 14, 1990

[54] AIR-FUEL RATIO CONTROLLER OF INTERNAL COMBUSTION ENGINE

[75] Inventors: Toshihisa Takahashi; Masanobu Uchinami, both of Himeji; Ryoji Nishiyama, Amagasaki; Seiya Kominami; Shinichi Nishida, both of Himeji, all of Japan

[73] Assignee: Mitsubishi Denki Kabushiki Kaisha, Tokyo, Japan

[21] Appl. No.: 320,652

[22] Filed: Mar. 8, 1989

[30] Foreign Application Priority Data

Mar. 8, 1988 [JP] Japan ..... 63-55247

[51] Int. Cl.[5] ..... F02D 41/14

[52] U.S. Cl. ..... 123/489; 204/406

[58] Field of Search ..... 123/440, 489, 493; 204/406, 425

[56] References Cited

U.S. PATENT DOCUMENTS

| | | | |
|---|---|---|---|
| 4,019,474 | 4/1977 | Nishimiya | 123/489 |
| 4,121,548 | 10/1978 | Hattori et al. | 123/489 |
| 4,332,225 | 6/1982 | Cox et al. | 123/440 |
| 4,464,244 | 8/1984 | Uchida et al. | 204/425 |
| 4,471,648 | 9/1984 | Uchida et al. | 123/440 |
| 4,611,562 | 9/1986 | Nakano et al. | 123/489 |
| 4,721,088 | 1/1988 | Mieno et al. | 123/489 |
| 4,765,298 | 8/1988 | Kojima et al. | 123/440 |
| 4,873,642 | 10/1989 | Mieno et al. | 123/440 |
| 4,889,098 | 12/1989 | Suzuki et al. | 123/440 |
| 4,895,123 | 1/1990 | Uchinami et al. | 123/440 |

FOREIGN PATENT DOCUMENTS

| | | | |
|---|---|---|---|
| 3517252 | 11/1985 | Fed. Rep. of Germany | 123/489 |
| 72561 | 5/1985 | Japan . | |

*Primary Examiner*—Tony M. Argenbright
*Assistant Examiner*—Robert E. Mates
*Attorney, Agent, or Firm*—Sughrue, Mion, Zinn, Macpeak & Seas

[57] ABSTRACT

The invention relates to an air-fuel (A/F) ratio controller of an internal combustion engine, which is provided with a constant-voltage circuit between the heater for heating the A/F ratio sensor and the power-supply source. Regardless of variation of voltage outputted from the power-supply source, the A/F ratio controller securely maintains the heater voltage constant and prevents occurrence of error in the signal outputted from the A/F ratio sensor by correctly operating the oxygen-concentration detecting element whose measuring precision is solely dependent on temperature.

1 Claim, 6 Drawing Sheets

AIR-FUEL RATIO CONTROLLER OF INTERNAL COMBUSTION ENGINE

BACKGROUND OF THE INVENTION

1. Field of the Invention

The present invention relates to a device for controlling the air-fuel (A/F) ratio of an internal combustion engine, more particularly, to an A/F ratio controller which constantly maintains voltage to be supplied to the heater for heating the A/F ratio sensor at the predetermined value.

2. Description of the Prior Art

When operating an internal combustion engine, in particular, which drives such a vehicle engine provided with ternary catalyzer for purifying exhaust gas, the A/F ratio of exhaust gas must strictly be held at the theoretical A/F ratio. Today, there is such a specific A/F ratio controller offered for use, which executes feedback control of A/F ratio by means of an A/F ratio sensor which sharply varies the level of output by applying the theoretical A/F ratio in order that the actual A/F ratio can approximate the theoretical A/F ratio.

Nevertheless, since the A/F ratio sensor of the abovecited A/F ratio controller can merely measure the theoretical A/F ratio, actually, this controller cannot execute feedback control of A/F ratio covering an extensive range. To compensate for such disadvantage, recently, a preceding art presents a system for controlling the A/F ratio using an A/F ratio sensor which is capable of measuring not only the theoretical A/F ratio, but can also continuously measure the A/F ratio from the rich to the lean degree according to the volume of specific component like oxygen present in the exhaust gas. This A/F ratio sensor incorporates an oxygen-concentration detecting element composed of ion-conductive solid electrolyte and a heater which activates this element. Unless held at the predetermined temperature by means of the heater, the oxygen-concentration detecting element of this A/F ratio sensor cannot correctly function. FIG. 1 is the graphical chart designating the relationship between temperature of the oxygen-concentration detecting element and deviation of signals outputted from the above-cited A/F ratio sensor. As is clear from this chart, independent of differential degrees of temperature borne by the oxygen-concentration detecting element against the predetermined reference level, deviation is generated from signals outputted from the A/F ratio sensor.

Generally, heater is heated by power voltage outputted from battery. Variation of the power voltage causes the caloric value of the heater to become variable, and as a result, the oxygen-concentration detecting element cannot fully be heated to the predetermined temperature. This in turn causes the oxygen-concentration detecting element to malfunction itself, thus generating deviation in signals outputted from this element and eventually degrading accuracy in the feedback control of the A/F ratio.

SUMMARY OF THE INVENTION

The invention has been achieved for fully solving those problems mentioned above.

The primary object of the invention is to fully eliminate deviation from signals outputted from the A/F ratio sensor so that the precision in the feedback control of the A/F ratio can securely be improved.

The second object of the invention is to securely stabilize voltage to be supplied to the heater which heats the oxygen-concentration detecting element so that this element can be held at a constant temperature.

The above and further objects and features of the invention will more fully be apparent from the following detailed description with accompanying drawings.

DESCRIPTION OF THE PREFERRED EMBODIMENTS

Figure 1:
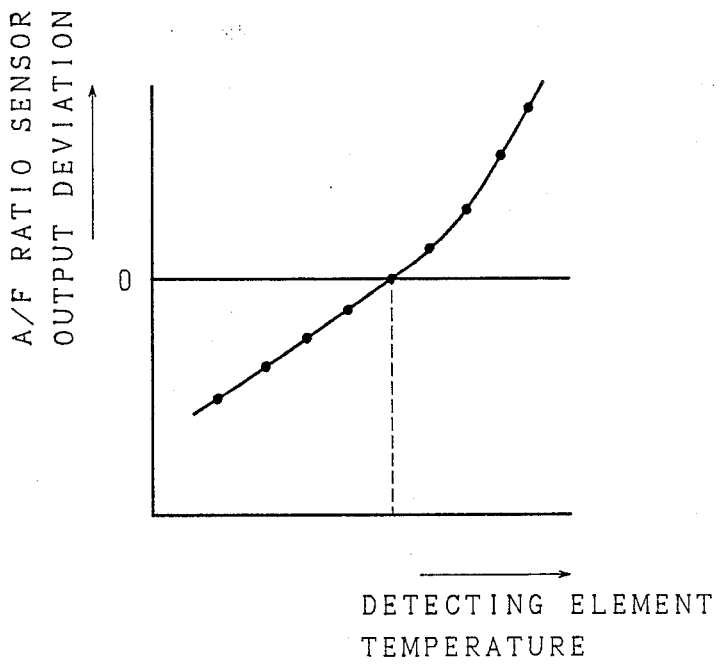
FIG. 1 is the graphical chart designating the relationship between temperature of oxygen-concentration detecting element and deviation of signals outputted from A/F ratio sensor of a conventional A/F ratio controller.
Figure 2:
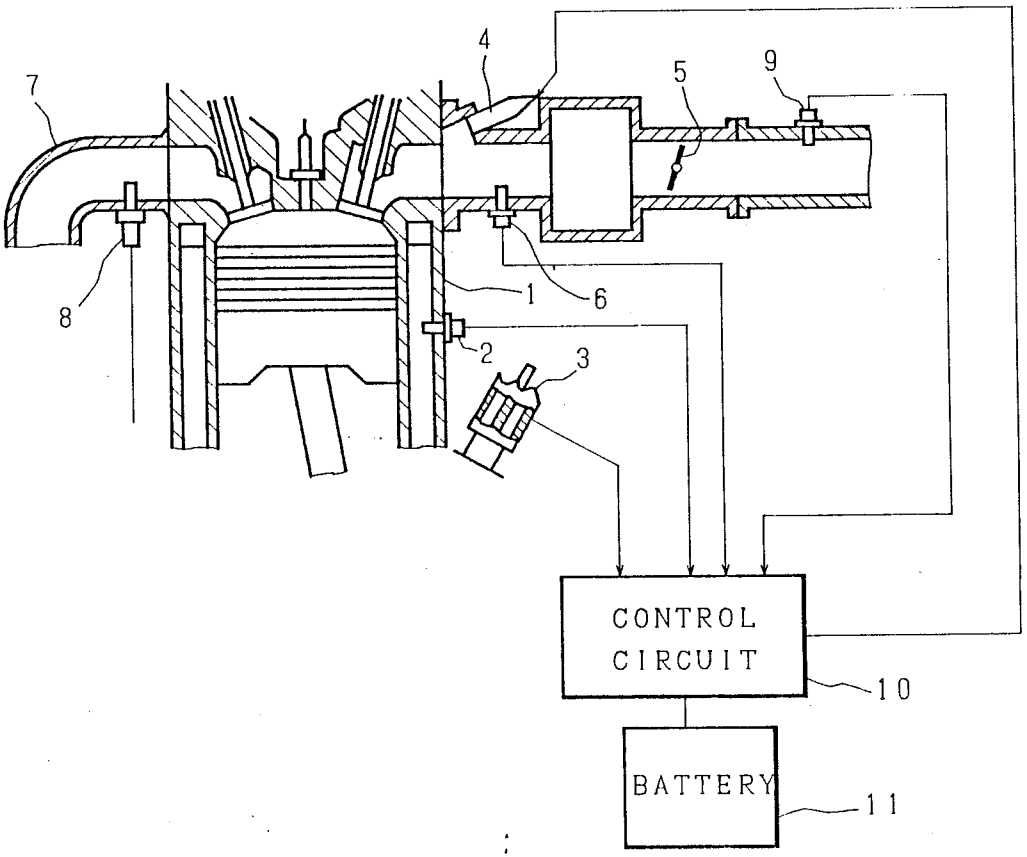
FIG. 2 is the schematic block diagram of the A/F ratio controller related to the invention.

The reference numerals 1 shown in FIG. 2 designates the engine. Radiated-water temperature sensor 2 detects temperature of radiated water. Crank-angle sensor 3 detects the number of the rotation of the engine 1. Fuel injector 4 feeds fuel in the engine 1. Throttle valve 5 adjusts volume of air flowing through air-inlet tube. Pressure sensor 6 detects absolute pressure of air-inlet system. The A/F ratio sensor 8 installed to the exhaust-gas tube 7 detects the A/F ratio by analyzing specific components present in exhaust gas. The A/F sensor 8 is provided with an oxygen-concentration detecting element and a heater which heats this element to the predetermined degree of temperature. Absorbed-air temperature sensor 9 detects temperature of absorbed air. Control circuit 10 receives signals from radiated-water temperature sensor 2, crank-angle sensor 3, pressure sensor 6, A/F ratio sensor 8, and absorbed-air temperature sensor 9, to control operation of the fuel-injector 4. Substantially, the control circuit 10 is composed of a microcomputer. The reference numeral 11 designates battery.

FIG. 2 designates the D-J format A/F ratio controller. The A/F ratio controller shown in FIG. 2 computes the basic injection pulse time on the basis of at least the value delivered from the pressure sensor 6 and the data, obtained from the crank angle 3, designating the number of the rotation of the engine 1. The control circuit 10 executes corrections and transitory corrections of those computed values by referring to signals from the radiated-water temperature sensor 2 and the absorbed-air temperature sensor 9, while it also executes feedback correction of those computed values by applying the A/F ratio sensor 8, and finally, the control circuit 10 determines the fuel-injection pulse time.

Figure 3:
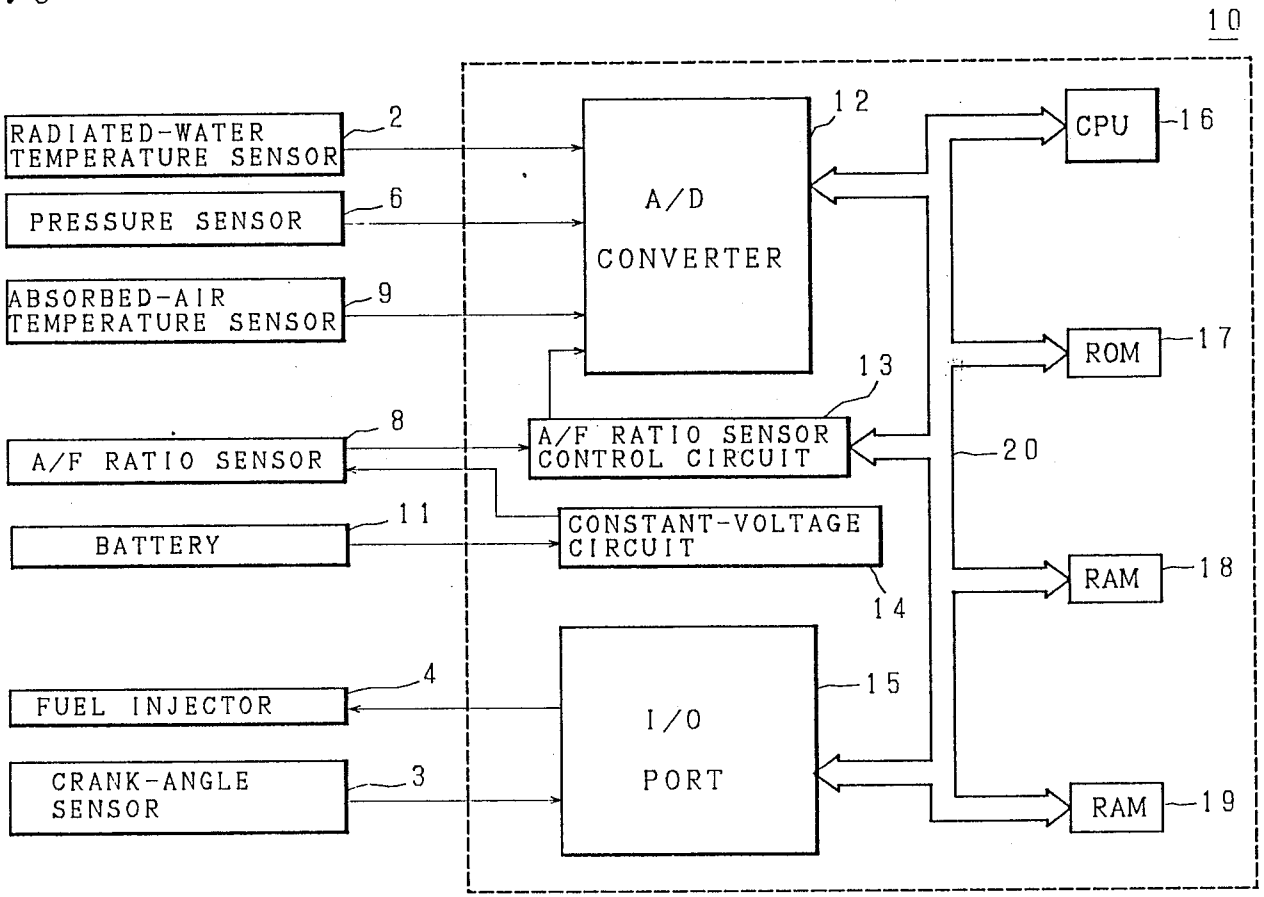
FIG. 3 is the schematic block diagram of the control circuit of the A/F ratio controller related to the invention.

FIG. 3 is the detailed block diagram of the control circuit 10. Central processing unit (CPU) 16 executes computations and operations for controlling the A/F ratio controller. ROM 17 stores programs. RAM 18 provisionally stores data. Power is constantly delivered to RAM 19 so that it can continuously retain data. Analog-digital (A/D) converter 12 converts analog signal into digital signal. The A/F ratio sensor control circuit 13 controls signals outputted from the A/F ratio sensor 8 in order that the sensor itself can output correct signals proportional to the actual A/F ratio.

The constant-voltage circuit 14 feeds constant voltage to the heater, installed inside of the A/F ratio sensor 8, for heating the oxygen-concentration sensor. I/O port 15 is the terminal which receives and outputs data. Bus 20 transfers data to and from respective elements of the control circuit 10. Signals outputted from the A/F ratio sensor 8 through the A/F ratio sensor control circuit 13 and signals outputted from the radiated-water temperature sensor 2, pressure sensor 6, absorbed-air temperature sensor 9 are delivered to the A/D converter 12. Signals outputted from the crank-angle sensor 3 are delivered to the I/O port 15. Fuel injector 4 receives control signals from the CPU 16 via the I/O port 15. On receipt of power from battery 11, the constant-voltage circuit 14 outputs constant voltage to the heater of the A/F ratio sensor 8.

Figure 4:
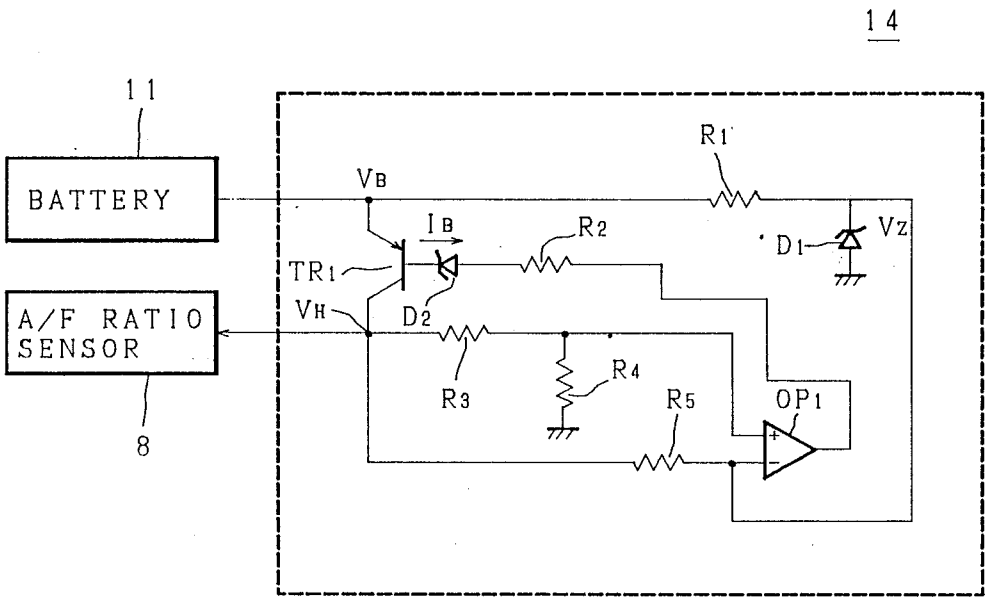
FIG. 4 is the schematic block diagram of the constant-voltage circuit shown in FIG. 3.

FIG. 4 is the schematic block diagram of the constant voltage circuit 14. Battery 11 is connected to emitter of transistor Tr1. Collector of transistor Tr1 is connected to the inverted input terminal (−) of operational amplifier OP1 via resistor R5. The middle of the wire connecting transistor Tr1 to resistor R5 is connected to the A/F ratio sensor 8 so that the sensor can receive voltage VH for heating the heater. Contact connected to the A/F ratio sensor 8 is connected to the non-inverted input terminal (+) of operation amplifier OP1 via resistor R3. Resistor R4 having a grounded terminal is connected to the middle of the wire connecting resistor R3 to the non-inverted input terminal (+) of operation amplifier OP1. The middle of the wire connecting resistor R5 to operation amplifier OP1 is connected to cathode of Zener diode D1, whereas the anode is grounded. Output terminal of operation amplifier OP1 is connected to the anode of Zener diode D2 via resistor R2, whereas the cathode of Zener diode D2 is connected to the base of transistor Tr1.

Next, functional operation of the constant-voltage circuit 14 is described below.

Battery 11 outputs 14 VDC of power voltage VB for example. The constant-voltage circuit 14 lowers this voltage VB to 10 VDC of the heater voltage VH for example, and then delivers it to the heater of the A/F ratio sensor 8. Voltage delivered to the inverted input terminal (−) of operation amplifier OP1 becomes Zener voltage VZ of Zener diode D1, where this voltage VZ remains constant. Resistors R3 and R4 divide the heater voltage VH into a specific voltage represented by expression $$\frac{R4}{R3 + R4} VH,$$

which is then delivered to the non-inverted input terminal (+) of operation amplifier OP1.

If the voltage delivered to the non-inverted input terminal (+) is higher than that is delivered to the inverted input terminal (−), the output terminal of operation amplifier OP1 becomes high. As a result, current IB flowing through the base of transistor Tr1 decreases to shift transistor Tr1 in the direction to become OFF. Consequently, heater voltage VH lowers. Conversely, if the voltage fed to the non-inverted input terminal (+) is lower than that is delivered to the inverted input terminal (−), the output terminal of operation amplifier OP1 goes low. As a result, current flowing through the base of transistor Tr1 increases, and then, the heater voltage VH rises. The constant-voltage circuit 14 then executes feedback control of voltage in order that the equation $$VZ = \frac{R4}{R3 + R4} VH$$

can be satisfied. The value of the Zener voltage VZ can be controlled to the predetermined value by adequately selecting values of resistors R3 and R4.

If the power voltage VB varies and rises itself, current IB flowing through the base of transistor Tr1 increases. In this case, the output terminal of operation amplifier OP1 goes high to decrease the base current IB, and as a result, the heater voltage also decreases. When the power voltage VB lowers current IB flowing through the base of transistor Tr1 decreases, and thus, the heater voltage VH also lowers. In this case, the output terminal of operation amplifier OP1 goes low to increase the base current IB, and thus, the heater VH also increases.

Figure 5:
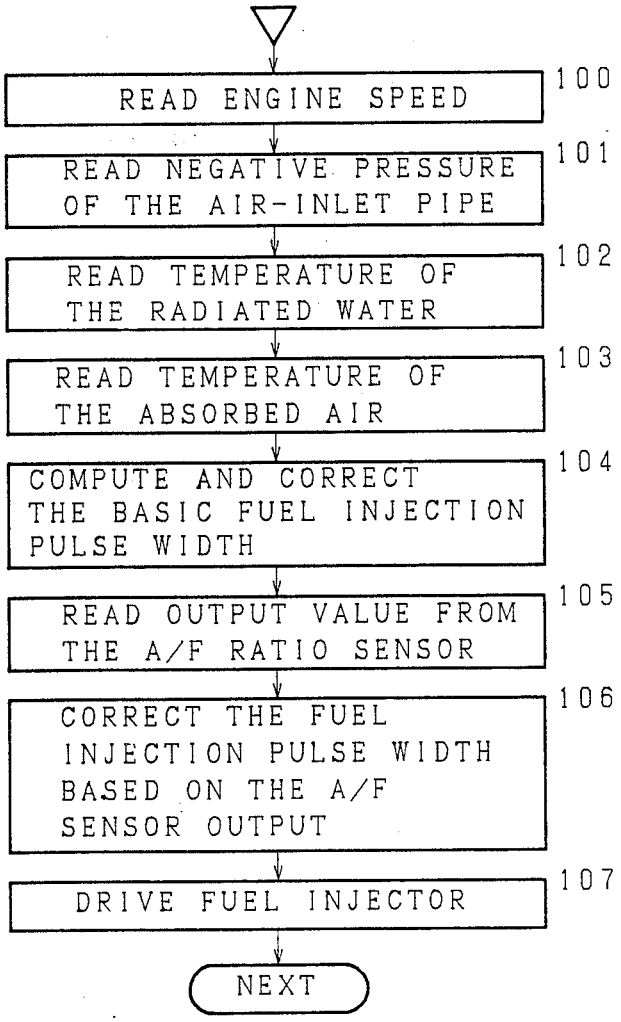
FIG. 5 is the flowchart designating the sequential procedure for controlling the A/F ratio related to the invention.

FIG. 5 is the flowchart designating procedure of executing the A/F ratio control operation in accordance with the programs stored in ROM 17. First, in step 100, the CPU 16 reads the number of the rotation of the engine 1 from signal output from the crank-angle sensor 3. Next, in step 101, the CPU 16 reads pressure present in the air-inlet tube from signal outputted from the pressure sensor 6. Next, in step 102, the CPU 16 reads temperature of radiated water from signal outputted from the radiated-water temperature sensor 2. Next, in step 103, the CPU 16 reads temperature of the absorbed air from signal outputted from the absorbed-air temperature sensor 9. Next, in step 104, the CPU 16 computes the basic fuel injection pulse width on the basis of the number of rotation of the engine 1 and the pressure inside of the air-inlet tube. The CPU 16 then corrects the computed value by referring to temperature of radiated water and temperature of absorbed air. In step 103, the CPU 16 reads signal outputted from the A/F ratio sensor 8. Next, in step 106, the CPU 16 corrects fuel injection pulse width in accordance with the deviation between the objective A/F ratio and the actual A/F ratio. Finally, in step 107, the CPU 16 drives fuel injector 4 by applying the corrected pulse width.

Figure 6:
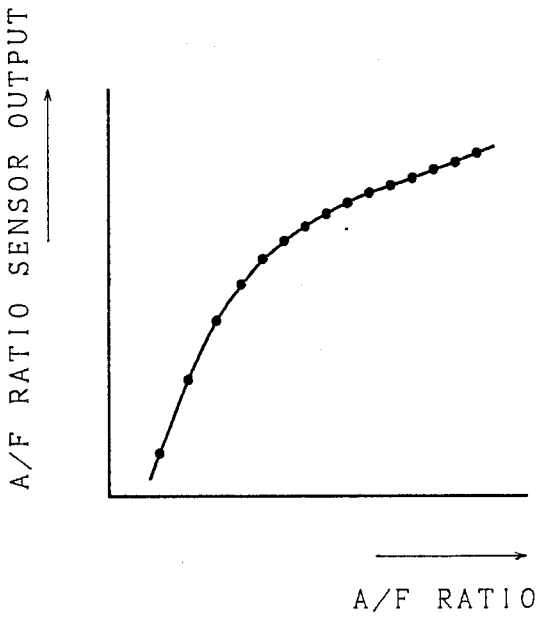
FIG. 6 is the graphical chart designating the relationship between signals outputted from the A/F ratio sensor and the A/F ratio generated by the A/F ratio control related to the invention.

FIG. 6 is the graphical chart designating the relationship between signals outputted from the A/F ratio sensor 8 and the actual A/F ratio presented by the A/F ratio controller embodied by the invention. The vertical axis designates signals outputted from the A/F ratio sensor 8, whereas the horizontal axis designates the A/F ratio. As is clear from the graphic chart shown in FIG. 6, when there is constant temperature which heats the heater, the level of signal outputted from the A/F ratio sensor 8 is proportional to the A/F ratio. Accordingly, the A/F ratio controller embodied by the invention capable of securely holding the heater-heating temperature constant totally prevents occurrence of incorrect A/F ratio control caused by deviation in the signal outputted from the A/F ratio sensor, thus eventually maintaining extremely precise A/F ratio control operation all the time.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such meets and bounds thereof are therefore intended to be embraced by the claims.

What is claimed is:

1. An air-fuel (A/F) ratio controller of an internal combustion engine comprising:

an A/F ratio sensor which is composed of the following: an oxygen-concentration detecting element for generating electric signals responsive to the oxygen concentration of the exhaust gas of said engine, and a heater which heats said oxygen-concentration detecting element to a predetermined temperature;

a controller for executing feedback control of a quantity of fuel to be supplied to said engine in accordance with electric signals generated by said oxygen-concentration detecting means so that the A/F ratio of the fuel-mixed vapor to be supplied to said engine can be predetermined A/F ratio; and a constant voltage circuit for maintaining voltage to be supplied to said heater constant; wherein said constant-voltage circuit is composed of the following: a Zener diode for lowering supply voltage to a predetermined voltage level, an operational amplifier whose one input terminal receives voltage from said Zener diode and whose other input terminal receives voltage representing the voltage to be supplied to said heater, and a transistor for adjusting said voltage to be supplied to said heater by applying base voltage received from said operational amplifier.

* * * * *